United States Patent [19]

Palethorpe

[11] 4,331,732

[45] May 25, 1982

[54] ACRYLIC FIBERS HAVING IMPROVED MOISTURE TRANSPORT PROPERTIES

[75] Inventor: George Palethorpe, Durham, N.C.

[73] Assignee: Monsanto Company, St. Louis, Mo.

[21] Appl. No.: 909,231

[22] Filed: May 24, 1978

[51] Int. Cl.[3] ..... D02G 3/00

[52] U.S. Cl. ..... 428/372; 428/364; 428/394

[58] Field of Search ..... 428/372, 364, 398, 400, 428/394

[56] References Cited

U.S. PATENT DOCUMENTS 2,612,679 10/1952 Ladisch ..... 428/372
2,885,308 5/1959 Healy, Jr. ..... 428/372
3,015,873 1/1962 Dietzsch et al. ..... 428/398
3,812,004 5/1974 Chinai et al. ..... 428/372 X
3,998,988 12/1976 Shimomai et al. ..... 428/400

*Primary Examiner*—Lorraine T. Kendell
*Attorney, Agent, or Firm*—Robert L. Broad, Jr.; John W. Whisler

[57] ABSTRACT

An acrylic fiber having dispersed therein 2 to 10 weight percent of a colloidal silica having an average particle size of about 1 to 4 microns, with a mean particle size of 2–3, preferably about 2, microns. This acrylic fiber has excellent whiteness and moisture transport characteristics and fabrics made from it have an improved crispness of hand.

4 Claims, 2 Drawing Figures

ACRYLIC FIBERS HAVING IMPROVED MOISTURE TRANSPORT PROPERTIES

BACKGROUND OF THE INVENTION a. Field of the Invention

This invention relates to acrylic fibers having improved moisture transport characteristics.

b. Description of the Prior Art

Synthetic fibers, such as nylon, polyester and acrylic have seen almost no use in end uses such as toweling, where moisture transport characteristics are of very high importance. The reason for this is that, generally, these fibers, in the form produced commercially, have poor moisture transport characteristics. Cotton, which has good moisture transport characteristics, is used almost exclusively in making fabrics, such as toweling, where good moisture transport characteristics are required.

The fibers of the present invention have good whiteness and moisture transport characteristics and in addition, when made into a fabric, give the fabric a crisp hand.

SUMMARY OF THE INVENTION

An acrylic fiber, containing 2 to 10 weight percent of colloidal silica having an average particle size of 1 to 4 microns, with a mean particle size of about 2–3 microns.

These fibers have good whiteness and moisture transport characteristics and, when made into a fabric, give the fabric a crisp hand. Other synthetic fibers do not have these desirable characteristics.

DETAILED DESCRIPTION OF THE INVENTION

Figure 1:
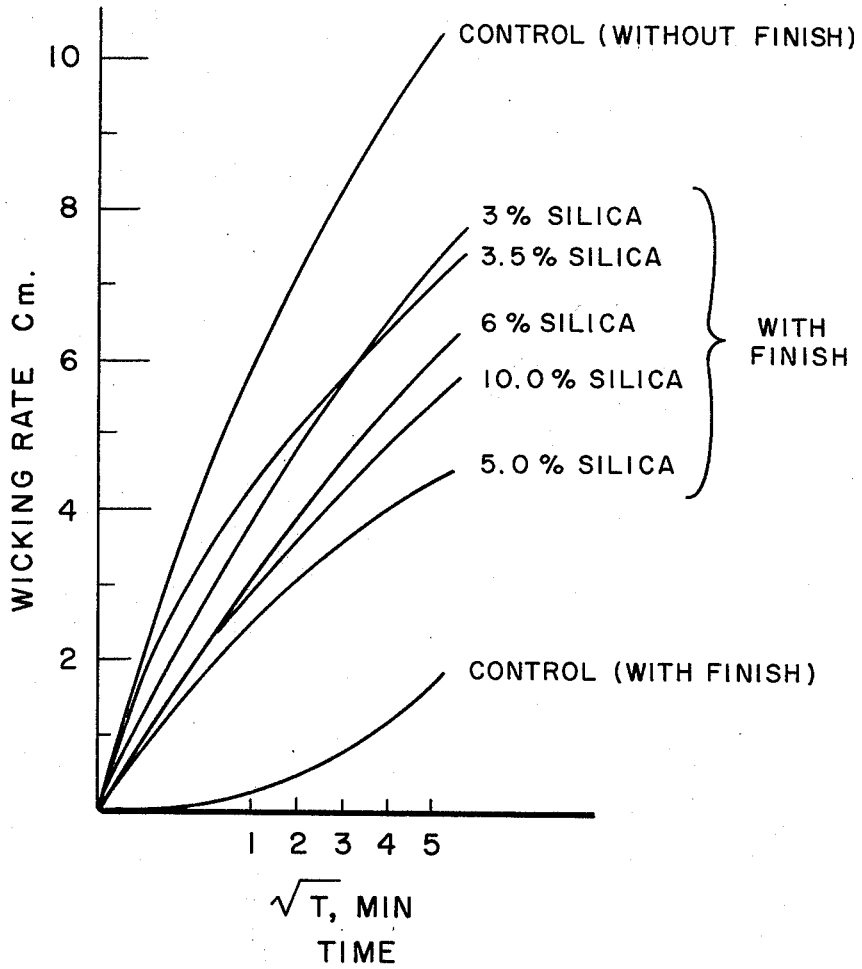

The fibers used in this invention are polymers of acrylonitrile with other mono-olefinic monomers which are copolymerizable with acrylonitrile. Acrylic polymers and methods of making them are well known. The mono-olefinic monomers which are copolymerizable with acrylonitrile are also well known to those skilled in the art.

Vinyl acetate is one of the preferred copolymers. Vinyl bromide and vinylidene chloride are preferred copolymers when the acrylonitrile content of the polymer is less than 85 weight percent. Small amounts of other mono-olefinic monomers, such as vinyl benzene sulfonate, may be polymerized with acrylonitrile and other monomers for enhancing various characteristics of fibers made from the polymer.

The acrylic fibers of this invention are prepared in a conventional manner. The invention lies in the addition of colloidal silica to the fibers to enhance the moisture transport and other properties of the fibers and fabrics made from the fibers.

Fibers are formed by dissolving the polymer in a solvent such as dimethylacetamide to give a solution having a polymer content of about 25 weight percent, based on solution weight. It is at this point that 2 to 10 weight percent of colloidal silica, based on polymer weight, is added to the solution to enhance moisture transport characteristics and other properties of fibers made from the polymer. The polymer solution, containing the dispersed silica, is filtered and passed through spinnerettes into a spin bath of about 57 weight percent of a solvent such as dimethylacetamide, with the remainder being water. The filaments are washed to remove solvent and are then stretched, dried and taken up. These process steps are conventional.

The amount of colloidal silica in the fiber is in the range of 2 to 10 percent, based on the weight of the fiber and the silica has an average particle size of about 1 to 4 microns. The mean particle size is about 2–3 microns, with a preferred mean particle size of about 2 microns.

The term "moisture transport" as used herein is a collective term meaning water absorbency, wicking rate and water retention. Moisture transport is measured herein in terms of wicking rate, since wicking rate is also a good indicator of water absorbency and water retention.

Conventional wet-spun acrylic fibers apparently have good moisture transport characteristics prior to application of a finish. Unfortunately, a finish is required on the fibers in order to process the fibers through textile machinery into fabric and this finish substantially reduces the moisture transport characteristics of the fibers. This problem is overcome in this invention by the use of colloidal silica in the fibers. Certain home laundry softeners may apply still more finish to the fibers and negate some of the good moisture transport characteristics of the fibers of this invention. Thus, it is believed that it would be best to forego the use of these home laundry softeners when washing fabrics made from the fibers of this invention.

If it should be desirable or necessary to add additional finish to the fiber, the moisture transport properties of the fibers may be significantly reduced or, in some cases, even eliminated. However, the fibers will still have an improved whiteness and fabric made from the fibers will have an improved crispness.

Fabrics were produced for testing by knitting continuous filament yarns having a denier of about 300 (individual filament denier: 2) on a Lawson knitter using a 54 gauge head at 30 inches per course.

Wicking rates were determined by taking a 15 by 2.54 centimeter strip of the knitted fabric and placing one end approximately 2.54 centimeters deep in water at room temperature and recording the distance the water moved up the strip versus time.

Water absorbency was measured by determining the amount of water which wicked into the fabric by capillary action in a given amount of time. This may be done by weighing the fabric before and after wetting or by measuring the amount of water taken from a source connected to the fabric by a capillary.

EXAMPLES

A copolymer of 93% acrylonitrile and 7% vinyl acetate was made by conventional methods. After separating polymer solids from water and unreacted monomers and then drying the polymer, the polymer was dissolved in dimethyl acetamide to give a solution having a polymer content of about 25 weight percent. Varying weight percents of colloidal silica having the particle size specified above were added to and dispersed throughout the polymer solution and filaments were spun from the solution by a known wet spinning process.

Specifically, the amount of colloidal silica added to the polymer solution in various runs was 3.0 weight percent, 3.5 weight percent, 5.0 weight percent, 6.0 weight percent and 10.0 weight percent. For purposes of comparison, the same copolymer containing no silica was spun into filaments.

Figure 2:
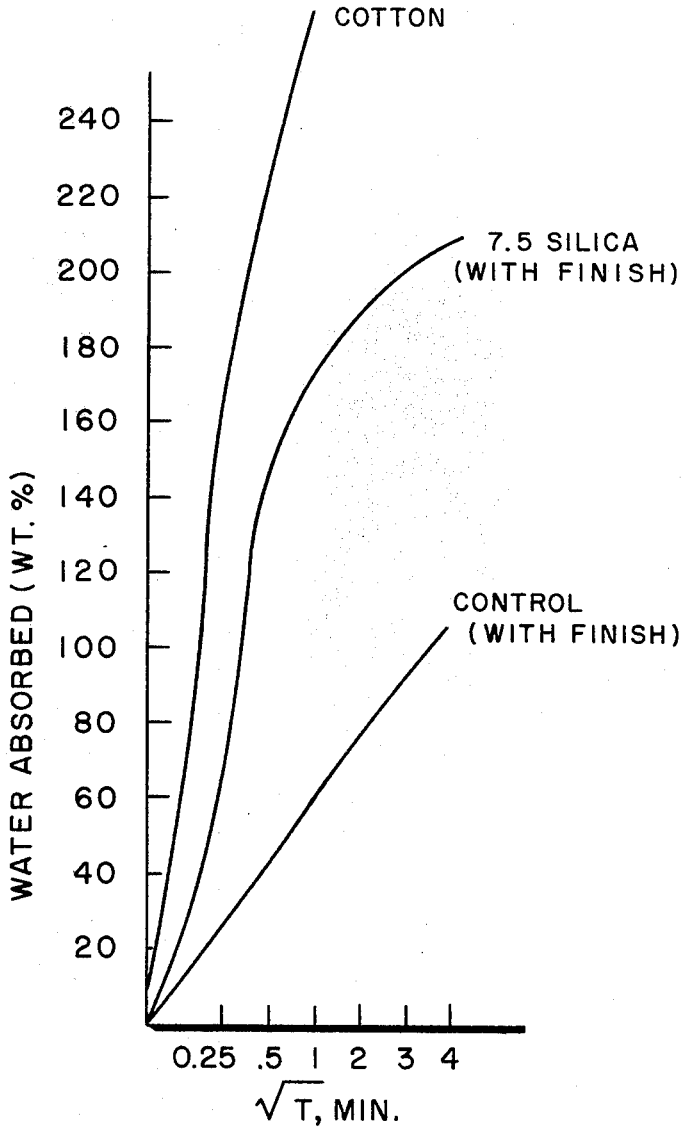

The results of wicking and water absorbency tests are shown in FIGS. 1 and 2 of the drawing. The finish referred to in the drawings is a conventional finish applied for the purpose of rendering the fibers processable into yarn on conventional textile machinery.

The curve in FIG. 1 labeled "Control (without finish)" shows the wicking capabilities of the fiber containing no silica and having no finish whatsoever. Because of the lack of a finish, this fiber could not be easily processed into yarn and fabric. The curve labeled "Control (with finish)" illustrates a dramatic decrease in wicking characteristics of the fiber, containing no silica, caused by addition of the finish necessary for allowing the fibers to be processed into yarn on textile machinery. It is necessary that this finish be added in order to make the fibers processable on conventional textile machinery.

The family of curves labeled "3.0% silica", etc., show the increase in wicking capability which is achieved by the use of these amounts of silica in fibers to which a finish has been applied. This increase in wicking capability can be observed by comparing the curve labeled "Control (with finish)" with the curves labeled "3.0% silica", etc. in FIG. 2.

In summary of FIG. 1, the curve labeled "Control (without finish)" shows the wicking rate of the original acrylic fiber with no finish and the curve labeled "Control (with finish)" shows how the addition of the necessary fiber finish decreases the wicking characteristics of the fiber. The group of curves in the middle of FIG. 1 illustrate the fact that, with the use of colloidal silica of this invention, wicking rates are not so substantially reduced when the required finish is applied to the fibers.

FIG. 2 illustrates the water absorbency of a fiber made from a copolymer of 93% acrylonitrile and 7% vinyl acetate with no silica and carrying a conventional textile finish, compared to the same fiber containing 7.5 weight percent of silica and carrying the same finish. This figure also shows the water absorbency of a swatch of fabric made from cotton and having no finish thereon.

While the examples are based on fibers containing at least 85 weight percent acrylonitrile and up to 15 weight of one or more other mono-olefinic copolymerized with the acrylonitrile, there is no reason to expect that modacrylic fibers would not be equivalent in result.

All of the fibers containing silica had an excellent whiteness when observed and the fabrics made from these fibers had a crisp hand. As the silica content of the fibers was increased toward the upper end, e.g. 5–10 weight percent, of the level specified herein, the fibers had an appearance similar to cotton.

What is claimed is:

1. A fiber having improved moisture transport characteristics, said fiber being made of at least 85 weight percent acrylonitrile and up to 15 weight percent of another mono-olefinic monomer copolymerized with said acrylonitrile, said fiber containing 2 to 10 weight percent of silica having an average particle size of 1 to 4 microns, said silica being dispersed through the fiber.

2. The fiber of claim 1 wherein the mean particle size is about 2–3 microns.

3. The fiber of claim 2 wherein the mean particle size is about 2 microns.

4. The fiber of claim 1 wherein the fiber contains 5 to 10 weight percent of said silica.

* * * * *